US009289077B1

(12) United States Patent
Gyasi

(10) Patent No.: US 9,289,077 B1
(45) Date of Patent: Mar. 22, 2016

(54) BABY WALKER SYSTEMS

(71) Applicant: Andrews K. Gyasi, Alexandria, VA (US)

(72) Inventor: Andrews K. Gyasi, Alexandria, VA (US)

( * ) Notice: Subject to any disclaimer, the term of this patent is extended or adjusted under 35 U.S.C. 154(b) by 81 days.

(21) Appl. No.: 14/099,961

(22) Filed: Dec. 8, 2013

Related U.S. Application Data

(60) Provisional application No. 61/871,274, filed on Aug. 28, 2013.

(51) Int. Cl.
*A63B 1/00* (2006.01)
*A47D 13/04* (2006.01)

(52) U.S. Cl.
CPC ..... *A47D 13/04* (2013.01)

(58) Field of Classification Search
CPC . A61H 3/04; A61H 2201/1633; A47D 13/04; A47D 13/043; B62K 9/02
See application file for complete search history.

(56) References Cited

U.S. PATENT DOCUMENTS 202,724 A * 4/1878 Headler ..... A47D 13/04 108/14
257,185 A * 5/1882 Price ..... A47D 13/04 482/68
701,582 A * 6/1902 Layng ..... B62B 5/0083 280/62
1,166,463 A * 1/1916 King ..... B62B 5/0083 280/62
1,300,292 A * 4/1919 Oshana ..... A61H 3/04 135/67
1,442,808 A * 1/1923 Huseman ..... B62B 5/067 280/7.1
1,492,202 A * 4/1924 Carroll ..... A47D 13/043 280/87.051
1,729,557 A * 9/1929 Stoll ..... A47D 13/043 135/67
1,856,538 A * 5/1932 Case ..... A63G 1/32 182/16
2,423,590 A * 7/1947 Fageol ..... B23K 7/004 16/21
2,463,744 A * 3/1949 Clemens ..... B64F 1/22 244/115
2,728,585 A * 12/1955 Walline ..... B62B 3/12 280/32.5
2,792,874 A * 5/1957 Sundberg ..... A61H 3/04 135/67
3,129,952 A * 4/1964 Rivers ..... A47D 13/043 280/87.051
3,529,819 A * 9/1970 Blank ..... A47D 13/04 482/68
3,992,024 A * 11/1976 Workman ..... A61G 5/00 280/87.041
4,159,110 A * 6/1979 Dodenhoff ..... A61H 3/04 135/67
4,230,331 A * 10/1980 Johnson ..... B62K 9/00 280/218
D265,391 S * 7/1982 Dearing ..... B62K 9/00 D34/18
4,526,390 A * 7/1985 Skolnik ..... B62K 9/02 280/282
4,569,532 A * 2/1986 Mirkarimi ..... B62B 7/00 280/32.5
4,681,332 A * 7/1987 Malone ..... A63B 9/0022 280/826
4,861,051 A * 8/1989 Napper ..... A61H 3/04 135/67
4,917,396 A * 4/1990 Meneses ..... B62K 5/08 224/415

(Continued)

*Primary Examiner* — Brodie Follman
(74) *Attorney, Agent, or Firm* — RG Patent Consulting, LLC; Rachel Gilboy

(57) ABSTRACT

A walker to assist an infant in walking system including an infant walker assembly having, a T-shaped base unit including a horizontal support bar and, a perpendicular support bar; a first vertical support bar; an angled support bar; a T-shaped handle; and at least three wheels coupled to the T-shaped base unit. The infant walker assembly is made of non-toxic coated metal material for safety of the infant. The horizontal support bar and the perpendicular support bar together form the T-Shaped base unit. The three wheels are positionally coupled to the T-shaped base-unit making said infant walker assembly movable so that said infant-user can push said infant walker assembly when learning how to walk.

19 Claims, 5 Drawing Sheets

(56) References Cited

U.S. PATENT DOCUMENTS

| | | | | | |
|---|---|---|---|---|---|
| 4,946,158 | A * | 8/1990 | Olayan | A47D 13/04 | 280/755 |
| 5,167,597 | A * | 12/1992 | David | A61H 3/04 | 280/267 |
| 5,588,457 | A * | 12/1996 | Tartaglia | A61H 3/04 | 135/85 |
| 6,848,696 | B2 * | 2/2005 | Miller | A61H 3/04 | 135/67 |
| 7,311,319 | B1 * | 12/2007 | Ortega | A61H 3/04 | 280/87.021 |
| 8,079,379 | B2 | 12/2011 | Peron | | |
| D651,946 | S * | 1/2012 | Funk | B62K 5/05 | D12/130 |
| 8,100,421 | B2 * | 1/2012 | Bennett | B62K 3/002 | 180/208 |
| 8,632,088 | B2 * | 1/2014 | Yerdon | B62K 5/05 | 280/221 |
| 8,814,183 | B1 * | 8/2014 | Durbin | B62B 7/044 | 280/47.38 |
| 2004/0012165 | A1 * | 1/2004 | Miller | A61H 3/04 | 280/87.01 |

* cited by examiner

BABY WALKER SYSTEMS

CROSS-REFERENCE TO RELATED APPLICATION

The present application is related to and claims priority from prior provisional application Ser. No. 61/871,274, filed Aug. 28, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of baby walkers and more specifically relates to a specially designed assistive walker configured expressly for use by infant children to provide a practical assist for infants, particularly those born with varying disabilities, in the developmental transition from crawling to walking.

DESCRIPTION OF THE RELATED ART

The first few years of a child's life are marked by many milestones, both physical and developmental. A first tooth, the first time a child rolls over unassisted and the first time a baby takes solid food are but a few of the precious moments which mark the steady development of an infant child. For many parents, the first time their child crawls is of special significance, as this new mobility is the first "step" many little ones take toward independence. Most babies learn to crawl between 6 and 10 months, after they have developed the strength to sit upright on their own.

A child's first toddling steps can begin immediately after learning to crawl, or can take several months to master. As most parents know, a child's first steps are often met with bumps and bruises as the inexperienced walker can easily loose his or her balance while trying to steady themselves on their feet or when trying to take quick steps. This is especially true for children who, as a result of premature birth or various medical disabilities, have slowed or compromised development.

Unfortunately, for these infants and many able-bodied children as well, the transition to walking can be an extremely challenging and arduous process that in worse case scenarios can render the child frustrated and sore. Since teaching a child to walk can be so difficult, many parents utilize infant walkers as a means of safely providing an infant mobility. Standard walkers are collapsible, saucer shaped units featuring a basket or sack style seat. Notably, these walkers rest atop four, wheeled casters which enable the child to safely propel the device in any direction, via their feet. Not surprisingly however, these walkers do little good if children lack the motor skills and strength to operate these devices.

Various attempts have been made to solve problems found in baby walker devices art. Among these are found in: U.S. Pat. No. 4,946,158 to Hamad Olayan et al; U.S. Pat. No. 202,724 to John H. Headier; and U.S. Pat. No. 8,079,379 to Antonio Vilar Peron. This prior art is representative of upright baby walkers. None of the above inventions and patents, taken either singly or in combination, is seen to describe the invention as claimed.

Ideally, a walker to assist an infant in walking system should be user-friendly and safe in-use and, yet would operate reliably and be manufactured at a modest expense. Thus, a need exists for a walker to assist an infant in walking system configured expressly for use by infants to provide a practical assist for infants, particularly those born with varying disabilities, in the developmental transition from crawling to walking and to avoid the above-mentioned problems.

BRIEF SUMMARY OF THE INVENTION

In view of the foregoing disadvantages inherent in the known of baby walker device art, the present invention provides a novel walker to assist an infant in walking system (Baby Walker System). The general purpose of the present invention, which will be described subsequently in greater detail is to provide a specially designed assistive walker configured expressly for use by infant children to provide a practical assist for infants, particularly those born with varying disabilities, in the developmental transition from crawling to walking.

A walker to assist an infant in walking system is disclosed herein comprising: an infant walker assembly having, a T-shaped base unit including a horizontal support bar and, a perpendicular support bar; a first vertical support bar; an angled support bar; a T-shaped handle; and at least three wheels coupled to the T-shaped base unit. The infant walker assembly preferably comprises non-toxic coated metal material for safety of the infant. The horizontal support bar and the perpendicular support bar together form the T-Shaped base unit. The horizontal support bar and the perpendicular support bar together form the T-Shaped base unit. The horizontal support bar may be fixedly coupled to the perpendicular support bar on the T-shaped base unit via a welding procedure (or may be integral).

The first vertical support bar is perpendicularly coupled to the T-shaped base unit. Further, the first vertical support bar and the angled support bar are coupled to the T-shaped base unit via welding. The angled support bar is angularly-coupled between the T-shaped base at a distal end of the perpendicular support bar and a top of the first vertical support bar thereby creating a triangular-gusseted configuration.

The T-shaped handle is mounted into an apex of the triangular-gusseted configuration where the first vertically mounted support bar and the angled support bar are coupled together, the T-shaped handle being received by the apex. The T-shaped handle is coupled to the triangular-gusseted configuration via welding. The T-shaped handle is able to be moved in relation to the triangular-gusseted configuration. Additionally the T-shaped handle provides a hand-gripping region for an infant-user to hold on to support a body weight of the infant-user.

The T-shaped handle preferably comprises coated nonskid, grooved rubber. The coated nonskid, grooved rubber permits the hands of the infant to facilitate a firm and comfortable grip during the in-use condition. The T-shaped handle is wider in diameter at a center of the T-shaped handle and tapers inwardly in a conical fashion towards terminal ends of the T-shaped handle. The tapering permits the infant to grip the T-shaped handle at a region that most comfortably conforms to the hands of the infant.

Each of the three wheels are positionally coupled to the T-shaped base-unit making the infant walker assembly movable so that the infant-user can push the infant walker assembly when learning how to walk. The at least three wheels coupled to said T-shaped base unit comprise heavy-duty castors in preferred embodiments. The heavy-duty castors comprise swivel castors to permit the infant walker assembly to move and rotate in various directions when in an in-use condition. The swivel castors allow the infant to move across a variety of non-planar surfaces. The first vertical support bar adds stability to the infant walker assembly in in-use conditions and on non-planar surfaces by adding balance to the infant walker assembly while decreasing the chance of the infant walker assembly tipping over.

A method of using a walker to assist an infant in walking system is disclosed herein comprising the steps of: choosing an infant walker assembly in a user-preferred color; placing the infant walker assembly in front of the infant; the infant placing hands on a T-shaped handle; the infant pulling themselves into a standing position; and the infant pushing the infant walker assembly to assist the infant in reaching a desired location.

The present invention holds significant improvements and serves as a walker to assist an infant in walking system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, walker to assist an infant in walking system, constructed and operative according to the teachings of the present invention.

The various embodiments of the present invention will hereinafter be described in conjunction with the appended drawings, wherein like designations denote like elements.

DETAILED DESCRIPTION

Figure 1:
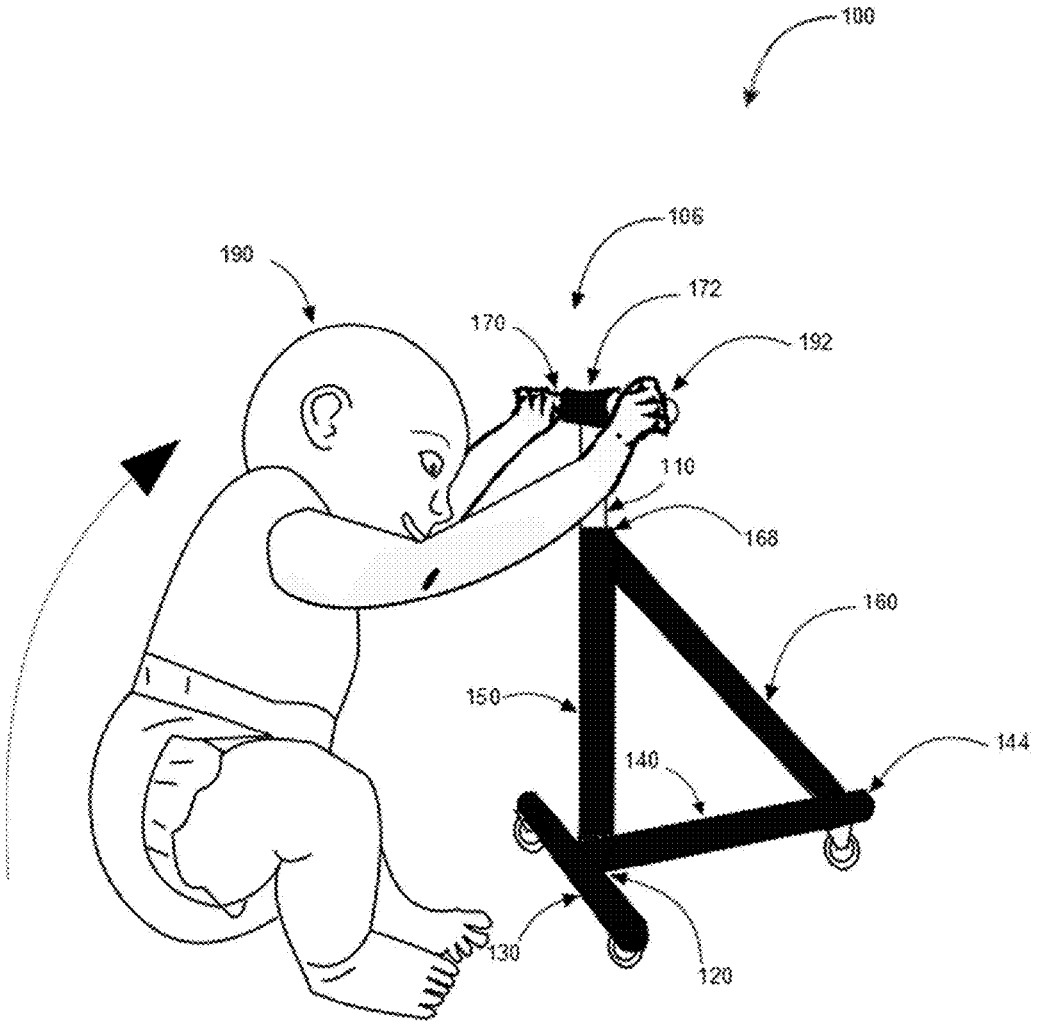
FIG. 1 shows a perspective view illustrating a walker to assist an infant in walking system in an in-use condition use condition according to an embodiment of the present invention.

As discussed above, embodiments of the present invention relate to a baby walker device and more particularly to a walker to assist an infant in walking system (Baby Walker System) configured expressly for use by infant children to provide a practical assist for infants, particularly those born with varying disabilities, in the developmental transition from crawling to walking through use of the present invention.

Generally speaking, the Baby Walker (walker to assist an infant in walking system) comprises a specially designed assistive walker configured expressly for use by children, particularly those with developmental disabilities.

Scaled for use by infant and toddler children, the Baby Walker could be manufactured primarily of coated metal or plastic material and would feature rubber and plastic components. This walker may be comprised of a T-shaped base unit featuring a horizontal support bar in the center of which a second support is perpendicularly attached. Designed to rest on the ground, this base support preferably features three, heavy duty wheeled castors which would move in all directions for balance, facilitating free and stable movement of the device. These wheels are appropriately positioned on the end of each of the base unit's support arms.

Vertically and centrally attached to the horizontal support arm may be a vertical support bar, reinforced by way of an angled support arm that is connected to the distal end of the base unit's perpendicular support, thus creating a triangular configuration. Mounted to the top of the juncture where the vertical and angled arm meet may be a T-shaped handle bar coated in nonskid, grooved rubber that facilitates a firm and comfortable hold during use. Importantly, this handle is wider in diameter at the center of the unit and taper inwards in a conical fashion towards its distal ends. In this manner, the child can grip the portion of the handle bar that most comfortably fits into their hands. The Baby Walker may be offered in a host of vibrant colors that appeal to children. Because the safety of the infant is of the utmost importance, the Baby Walker would be manufactured to meet all guidelines for children's furniture as set by the Juvenile Products Manufactures Association (JPMA).

The Baby Walker provides parents and caregivers a sturdy and reliable infant walker which greatly assists a child in the transition from crawling to standing upright and walking. Offering an innovative design developed expressly with the needs of disabled children in mind, the Baby Walker provides a practical and easily employed alternative to traditional saucer-style walkers that are navigated only by the child's feet.

With this unique walker's wheels designed to move in tandem across a variety of surfaces and the vertical support facilitating sure and stable balance, the Baby Walker may significantly reduce the time it takes for a child to transition from crawling to walking. This advantage may prove appealing to the parents of both disabled and able-bodied infants and toddlers. Offering reliable support to the child as they walked, use the Baby Walker could effectively prevent the child from toppling over and accidentally slipping and falling when taking their first, tentative steps.

Allowing the active child the freedom to comfortably stand in the upright position, as well as to easily turn in any direction, this innovative walker encourages the child to explore their environment, as well as to freely move all of their limbs.

Referring to the drawings by numerals of reference there is shown in FIGS. 1-4, perspective views illustrating walker to assist an infant in walking system 100 according to an embodiment of the present invention.

Walker to assist an infant in walking system 100 comprises: infant walker assembly 110 having T-shaped base unit 120 including horizontal support bar 130 and, perpendicular support bar 140; first vertical support bar 150; angled support bar 160; T-shaped handle 170; and at least three wheels 180 coupled to T-shaped base unit 120. Infant walker assembly 110 comprises non-toxic coated metal material for safety of infant 190. Upon reading this specification, it should be appreciated that, under appropriate circumstances, considering such issues as user preferences, design preference, structural requirements, marketing preferences, cost, available materials, technological advances, etc., other material arrangements such as, for example, non-toxic coated plastic material, etc., may be sufficient.

Horizontal support bar 130 and perpendicular support bar 140 together form T-Shaped base unit 120. Horizontal support bar 130 is fixedly coupled to perpendicular support bar 140 on T-shaped base unit 120 via a welding procedure. Upon reading this specification, it should be appreciated that, under appropriate circumstances, considering such issues as user preferences, design preference, structural requirements, marketing preferences, cost, available materials, technological advances, etc., other coupled arrangements such as, for example, fasteners, etc., may be sufficient.

First vertical support bar 150 is perpendicularly coupled to T-shaped base unit 120. Further, first vertical support bar 150 and angled support bar 160 are coupled to T-shaped base unit 120 via welding or at least one fastener. Those with ordinary skill in the art will now appreciate that upon reading this specification and by their understanding the art of welding and fastener as described herein, methods of coupling the first vertical support bar 150 and angled support bar 160 are coupled to the T-shaped base unit will be understood by those knowledgeable in such art. Angled support bar 160 is angularly-coupled between T-shaped base 120 at distal end 144 of perpendicular support bar 140 and top 154 of first vertical support bar 150 thereby creating triangular-gusseted configuration 166.

T-shaped handle 170 is mounted into apex 168 of triangular-gusseted configuration 166 where first vertically mounted support bar 150 and angled support bar 160 are coupled together, T-shaped handle 170 being received by apex 168. T-shaped handle 170 is coupled to triangular-gusseted configuration 166 via welding. Those with ordinary skill in the art will now appreciate that upon reading this specification and by their understanding the art of welding and fastener as described herein, methods of coupling T-shaped handle 170 to triangular-gusseted configuration 166 will be understood by those knowledgeable in such art. T-shaped handle 170 is able to be moved in relation to triangular-gusseted configuration 166. Additionally T-shaped handle 170 provides hand-gripping region 194 for infant-user 190 to hold on to support a body weight of infant-user 190 as shown in in-use condition 106 of FIG. 1 and in-use condition 206 of FIG. 2.

T-shaped handle 170 comprises coated nonskid, grooved rubber 172. The coated nonskid, grooved rubber permits hands 192 of infant 190 to facilitate a firm and comfortable grip during in-use condition 106 and 206. T-shaped handle 170 is wider in diameter at a center of T-shaped handle 170 and tapers inwardly in a conical fashion towards terminal ends of T-shaped handle 170. The tapering permits infant 190 to grip T-shaped handle 170 at a region that most comfortably conforms to hands 192 of infant 190.

Figure 2:
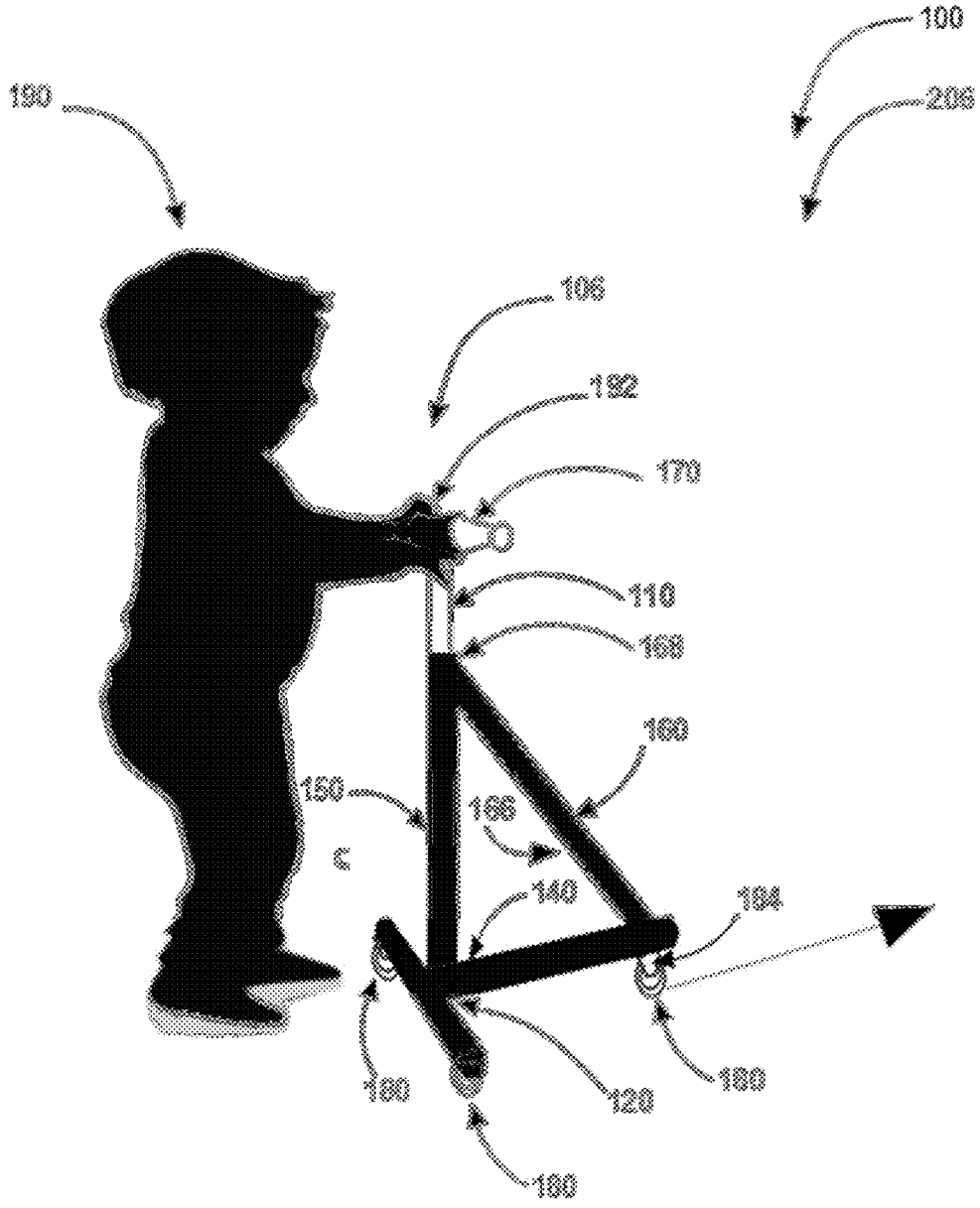
FIG. 2 is a perspective view illustrating the walker to assist an infant in walking system in another in-use condition according to an embodiment of the present invention of FIG. 1.
Figure 3:
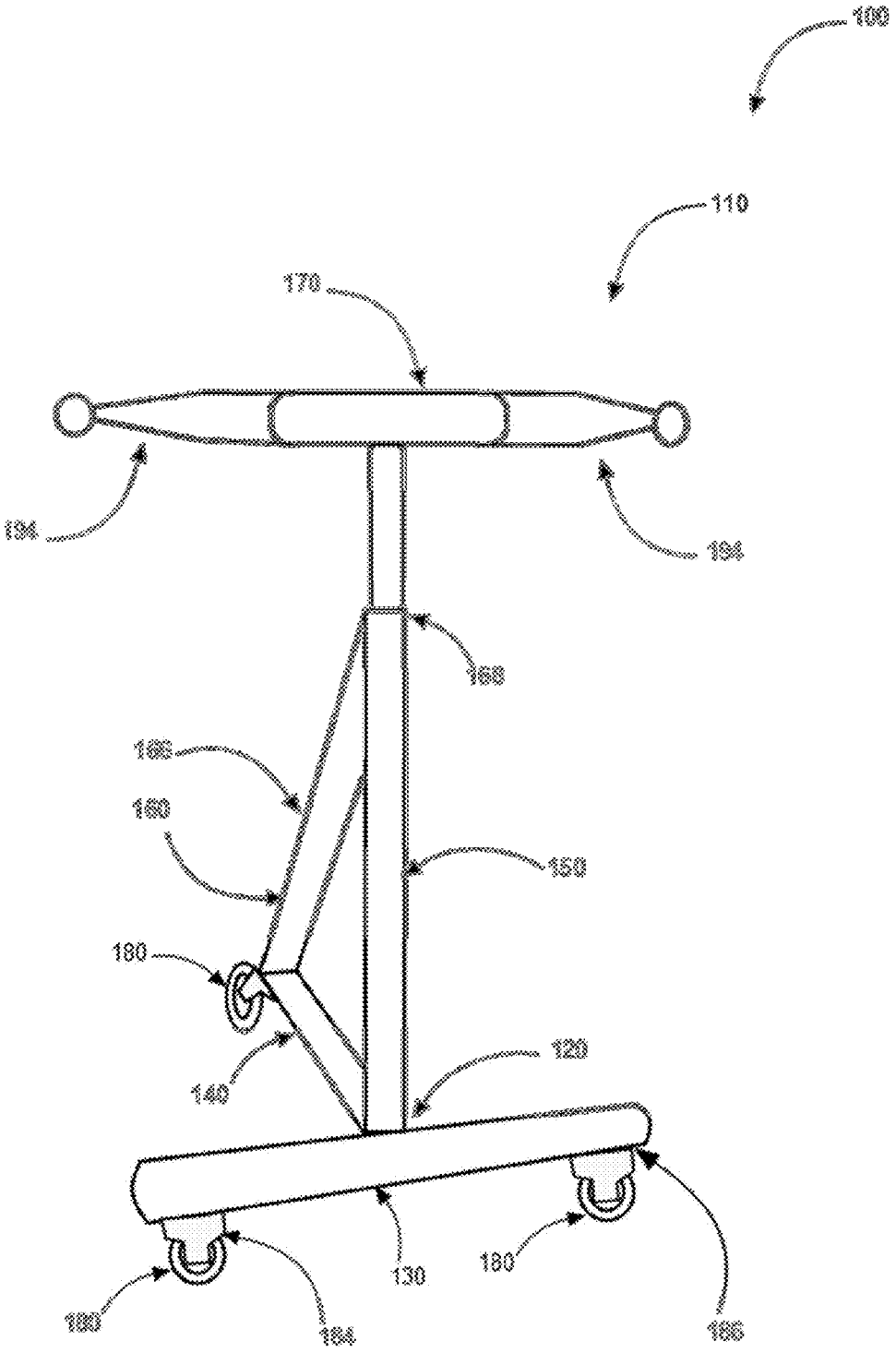
FIG. 3 is a perspective view illustrating an infant walker assembly of the walker to assist an infant in walking system according to an embodiment of the present invention of FIGS. 1 and 2.
Figure 4:
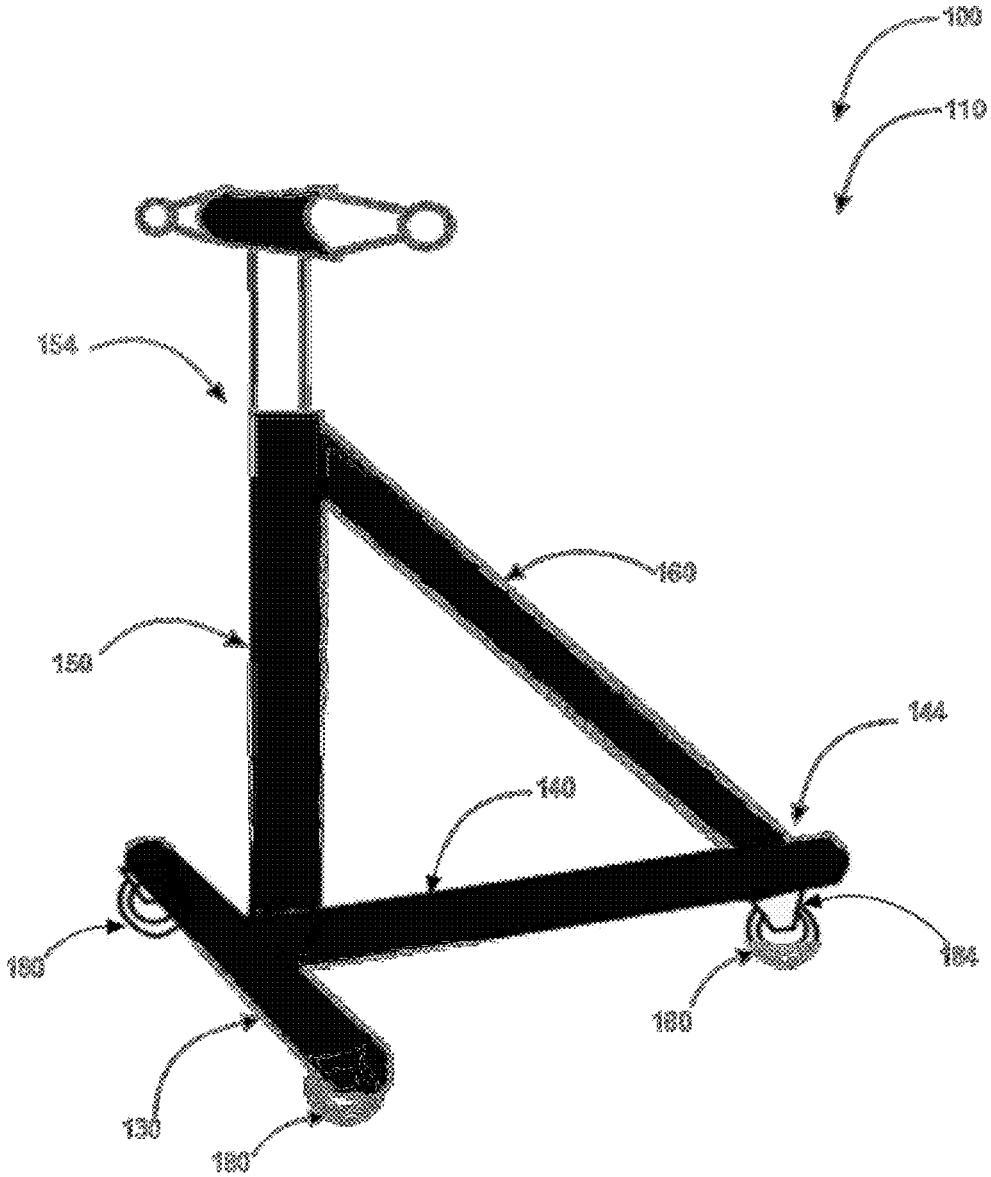
FIG. 4 is yet another perspective view illustrating infant walker assembly of the walker to assist an infant in walking system according to an embodiment of the present invention of FIGS. 1-3.

Each of three wheels 180 are positionally coupled to T-shaped base-unit 120 making infant walker assembly 110 movable so that infant-user 190 can push infant walker assembly 110 when learning how to walk. At least three wheels 180 coupled to T-shaped base unit 120 preferably comprise heavy-duty castors 184. Heavy-duty castors 184 comprise swivel castors to permit infant walker assembly 110 to move and rotate in various directions when in in-use condition 206 as shown in FIG. 2. Swivel castors 184 allow infant 190 to move across a variety of planar surfaces and non-planar surfaces. First vertical support bar 150 adds stability to infant walker assembly 110 in in-use conditions 106 and 206 especially while and on non-planar surfaces by adding balance to infant walker assembly 110 while decreasing the chance of infant walker assembly 110 tipping over.

Figure 5:
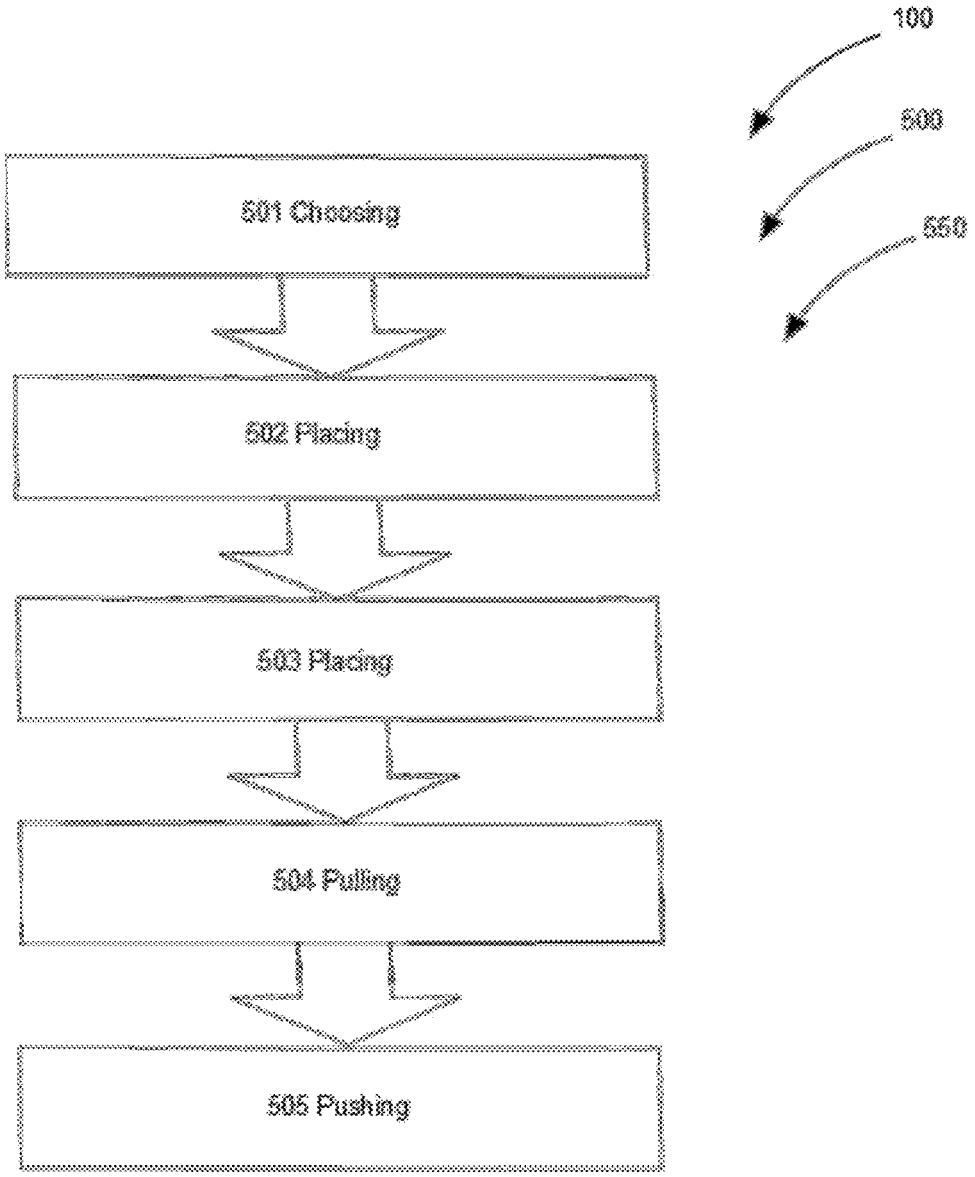
FIG. 5 is a flowchart illustrating a method of use for the infant walker assembly of the walker to assist an infant in walking system according to an embodiment of the present invention of FIGS. 1-4.

Referring now to FIG. 5, flowchart 550 illustrating method of use 500 for walker to assist an infant in walking system 100 according to an embodiment of the present invention of FIGS. 1-4.

Method of use 500 for walker to assist an infant in walking system 100 is preferably comprises the steps of: step one 501 choosing infant walker assembly 110 in a user-preferred color; step two 502 placing infant walker assembly 110 in front of infant 190; step three 503 infant 190 placing hands on T-shaped handle 170; step four 504 infant 190 pulling themselves into a standing position; and step five 505 infant 190 pushing infant walker assembly 110 to assist infant 190 in reaching a desired location.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A walker to assist an infant in walking system comprising:

an infant walker assembly having, a T-shaped base unit including, a horizontal support bar and, a perpendicular support bar;

a first vertical support bar;

an angled support bar;

a T-shaped handle; and at least three wheels coupled to said T-shaped base unit;

wherein said horizontal support bar and said perpendicular support bar together form said T-Shaped base unit;

wherein said first vertical support bar is perpendicularly coupled to said T-shaped base unit;

wherein said angled support bar is angularly-coupled between said T-shaped base at a distal end of said perpendicular support bar and a top of said first vertical support bar thereby creating a triangular-gusseted configuration;

wherein said T-shaped handle is mounted into an apex of said triangular-gusseted configuration where said first vertically mounted support bar and said angled support bar are coupled together, said T-shaped handle being received by said apex;

wherein said T-shaped handle provides a hand-gripping region for a infant-user to hold on to support a body weight of said infant-user; and wherein each of said three wheels is positionally coupled to said T-shaped base-unit making said infant walker assembly movable so that said infant-user can push said infant walker assembly when learning how to walk.

2. The walker to assist an infant in walking system of claim 1 wherein said infant walker assembly comprises non-toxic coated metal material for safety of said infant.

3. The walker to assist an infant in walking system of claim 2 wherein said non-toxic coated plastic material of said infant walker assembly comprises plastic.

4. The walker to assist an infant in walking system of claim 1 wherein said horizontal support bar is fixedly coupled to said perpendicular support bar on said T-shaped base unit via a welding procedure.

5. The walker to assist an infant in walking system of claim 1 wherein said horizontal support bar is coupled to said perpendicular support bar on said T-shaped base unit via at least one fastener.

6. The walker to assist an infant in walking system of claim 1 wherein said first vertical support bar and said angled support bar are coupled to said T-shaped base unit via welding.

7. The walker to assist an infant in walking system of claim 1 wherein said first vertical support bar and said angled support bar are coupled to said T-shaped base unit via at least one fastener.

8. The walker to assist an infant in walking system of claim 1 wherein said T-shaped handle is coupled to said triangular-gusseted configuration via welding.

9. The walker to assist an infant in walking system of claim 1 wherein said T-shaped handle is able to be moved in relation to said triangular-gusseted configuration.

10. The walker to assist an infant in walking system of claim 1 wherein said at least three wheels coupled to said T-shaped base unit comprise heavy-duty castors.

11. The walker to assist an infant in walking system of claim 10 wherein said heavy-duty castors comprise swivel castors to permit said infant walker assembly to move and rotate in various directions when in an in-use condition.

12. The walker to assist an infant in walking system of claim 11 wherein said swivel castors allow said infant to move across a variety of planar surfaces.

13. The walker to assist an infant in walking system of claim 11 wherein said swivel castors allow said infant to move across a variety of non-planar surfaces.

14. The walker to assist an infant in walking system of claim 1 wherein said first vertical support bar adds stability to said infant walker assembly in in-use conditions and on non-planar surfaces by adding balance to said infant walker assembly while decreasing the chance of said infant walker assembly tipping over.

15. The walker to assist an infant in walking system of claim 13 wherein said T-shaped handle comprises coated nonskid, grooved rubber.

16. The walker to assist an infant in walking system of claim 15 wherein said coated nonskid, grooved rubber permits said hands of said infant to facilitate a firm and comfortable grip during said in-use condition.

17. The walker to assist an infant in walking system of claim 1 wherein said T-shaped handle is wider in diameter at a center of said T-shaped handle and tapers inwardly in a conical fashion towards terminal ends of said T-shaped handle.

18. The walker to assist an infant in walking system of claim 17 wherein said tapering permits said infant to grip said T-shaped handle at a region that most comfortably conforms to said hands of said infant.

19. A walker to assist an infant in walking system comprising:

an infant walker assembly having, a T-shaped base unit including, a horizontal support bar and, a perpendicular support bar;

a first vertical support bar;

an angled support bar;

a T-shaped handle; and at least three wheels coupled to said T-shaped base unit;

wherein said infant walker assembly comprises non-toxic coated metal material for safety of said infant;

wherein said horizontal support bar and said perpendicular support bar together form said T-Shaped base unit;

wherein said horizontal support bar is fixedly coupled to said perpendicular support bar on said T-shaped base unit via a welding procedure;

wherein said first vertical support bar is perpendicularly coupled to said T-shaped base unit;

wherein said first vertical support bar and said angled support bar are coupled to said T-shaped base unit via welding;

wherein said angled support bar is angularly-coupled between said T-shaped base at a distal end of said perpendicular support bar and a top of said first vertical support bar thereby creating a triangular-gusseted configuration;

wherein said T-shaped handle is mounted into an apex of said triangular-gusseted configuration where said first vertically mounted support bar and said angled support bar are coupled together, said T-shaped handle being received by said apex;

wherein said T-shaped handle is coupled to said triangular-gusseted configuration via welding;

wherein said T-shaped handle is able to be moved in relation to said triangular-gusseted configuration;

wherein said T-shaped handle provides a hand-gripping region for a infant-user to hold on to support a body weight of said infant-user;

wherein said T-shaped handle comprises coated nonskid, grooved rubber;

wherein said coated nonskid, grooved rubber permits said hands of said infant to facilitate a firm and comfortable grip during said in-use condition;

wherein said T-shaped handle is wider in diameter at a center of said T-shaped handle and tapers inwardly in a conical fashion towards terminal ends of said T-shaped handle;

wherein said tapering permits said infant to grip said T-shaped handle at a region that most comfortably conforms to said hands of said infant;

wherein each of said three wheels is positionally coupled to said T-shaped base-unit making said infant walker assembly movable so that said infant-user can push said infant walker assembly when learning how to walk;

wherein said at least three wheels coupled to said T-shaped base unit comprise heavy-duty castors;

wherein said heavy-duty castors comprise swivel castors to permit said infant walker assembly to move and rotate in various directions when in an in-use condition;

wherein said swivel castors allow said infant to move across a variety of non-planar surfaces; and wherein said first vertical support bar adds stability to said infant walker assembly in in-use conditions and on non-planar surfaces by adding balance to said infant walker assembly while decreasing the chance of said infant walker assembly tipping over.

* * * * *